US007367697B2

(12) United States Patent
George

(10) Patent No.: US 7,367,697 B2
(45) Date of Patent: May 6, 2008

(54) DECORATIVE LIGHT SUPPORT DEVICE

(76) Inventor: Michael Brent George, 1390 W. Lynn, Slaton, TX (US) 79364

( * ) Notice: Subject to any disclaimer, the term of this patent is extended or adjusted under 35 U.S.C. 154(b) by 38 days.

(21) Appl. No.: 11/385,323

(22) Filed: Mar. 21, 2006

(65) Prior Publication Data

US 2007/0223221 A1 Sep. 27, 2007

(51) Int. Cl.
*F21V 21/00* (2006.01)

(52) U.S. Cl. ..... 362/396; 362/145; 362/398; 52/28; 248/206.5; 248/237

(58) Field of Classification Search ..... 362/145, 362/249, 396, 398; 52/28; 248/229.12, 248/229.16, 229.26, 206.5, 237
See application file for complete search history.

(56) References Cited

U.S. PATENT DOCUMENTS 3,182,944 A * 5/1965 Laviano ..... 248/229.12
3,883,926 A * 5/1975 Reynolds ..... 248/229.16
4,851,977 A 7/1989 Gary

* cited by examiner

*Primary Examiner*—Stephen F Husar
(74) *Attorney, Agent, or Firm*—Mark E. Scott; Conley Rose, P.C.

(57) ABSTRACT

At least some of the illustrative embodiments are decorative light support device comprising a bulb retention portion having an aperture and an affixation portion coupled to the bulb retention portion. The affixation portion comprises a first straddle member and a second straddle member. The first and second straddle members are configured to straddle an overhang portion of a roofing material and to at least partially affix the decorative light support device to the roofing material.

14 Claims, 2 Drawing Sheets

DECORATIVE LIGHT SUPPORT DEVICE

CROSS REFERENCE TO RELATED APPLICATION

This application is related to Disclosure Document number 549,586 filed Mar. 23, 2004. Specific reference is made to that document.

BACKGROUND

Several types of devices exist to assist home owners and business owners in attaching decorate lights to the exterior of their buildings, usually seasonally, such as during the Christmas holidays. Some of these devices are adapted to assist the home owner or business owner in attaching the decorative lighting to hang from rain gutters. Others of these devices attach by sliding between the roofing material (e.g., composition shingles) and the roof decking material.

However, a growing trend in the construction industry is the use of sheet metal roofs instead of composition shingles. In most cases, the sheet metal roofs extend beyond the fascia material by several inches, thus making the support brackets configured to slide between the roofing material and the roof decking material unusable.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either a direct or indirect connection. Thus, if a first device couples to a second device, that connection may be through a direct connection, or through an indirect connection via other devices and connections.

DETAILED DESCRIPTION

Figure 1:
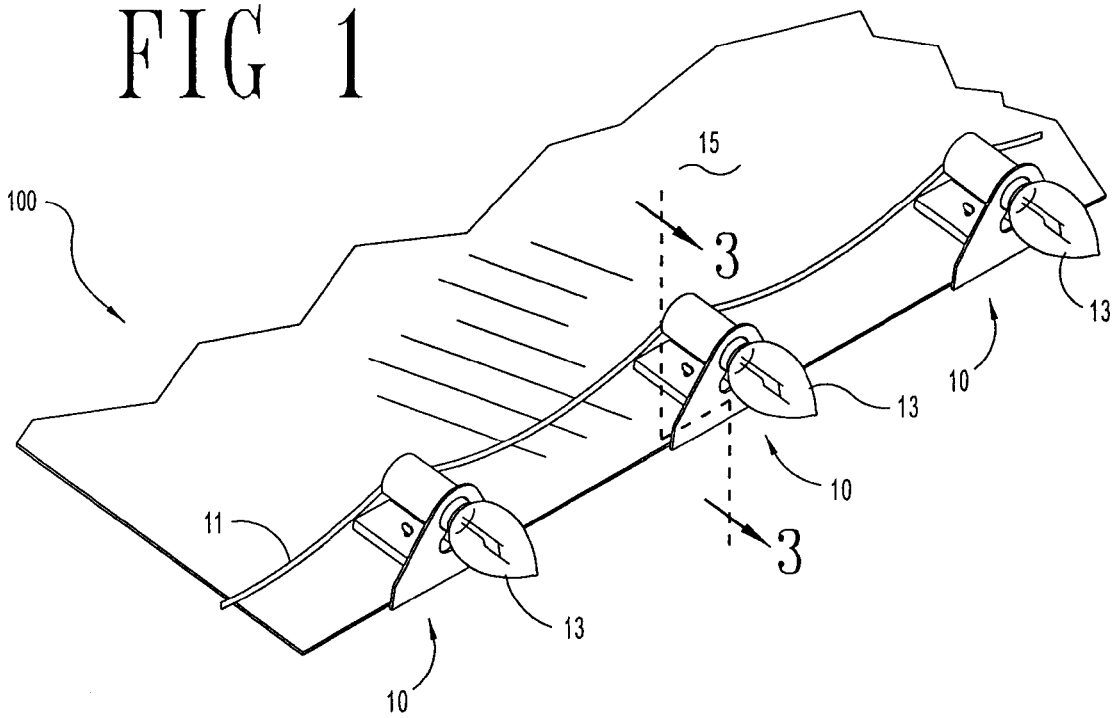
FIG. 1 illustrates use of decorative light support devices in accordance with embodiments of the invention.

FIG. 1 illustrates a decorative light hanging system 100 in accordance with embodiments of the invention. In particular, each decorative bulb 13 is held in place on a sheet metal roof 15 by way of a decorative light support device 10. The decorative light support device 10 holds the bulb 13 in a consistent orientation across the installation, and also allows the consistent spacing of the bulbs 13 for an aesthetically pleasing configuration.

Figure 2:
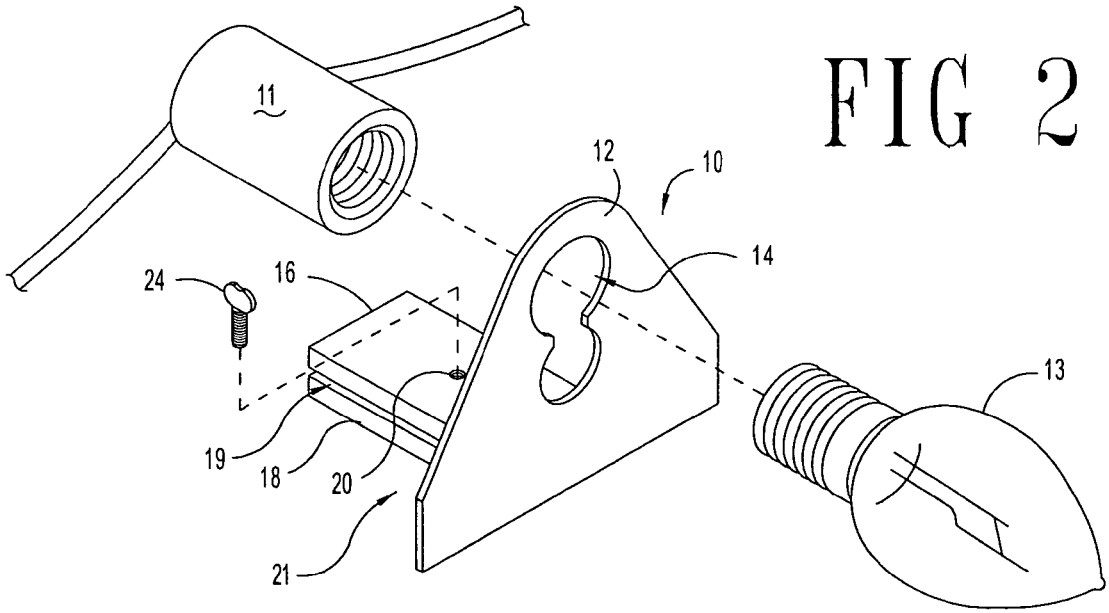
FIG. 2 illustrates a decorative light support device in greater detail.

FIG. 2 shows in greater detail the decorative light support device 10 in accordance with at least some embodiments of the invention. In particular, FIG. 2 illustrates that the decorative light support device 10 comprises a bulb retention portion 12 having an aperture 14 therein. As illustrated in FIG. 2, the bulb base extends through the aperture 14 and threadingly couples to the socket 11. In this way, the bulb 13 and socket 11 are affixed to the bulb retention portion 12. In alternative embodiments, the bulb 13 may couple to the socket 11 through an unthreaded friction-type engagement. As illustrated in FIG. 2, the aperture 14 may be configured to have effectively two (or more) circular portions such that bulb 13 and socket 11 assemblies of different sizes may be used with the decorative light support device 10.

Still referring to FIG. 2, the decorative light support device 10 further comprises an affixation portion 21. The affixation portion 21 defines a plane that, in at least some embodiments, is substantially perpendicular to the plane defined by the bulb retention portion 12. In alternative embodiments of the invention, the angle formed between the bulb retention portion 12 and the affixation portion 21 may be less than 90 degrees (e.g., such that the bulb was held substantially parallel to the ground independent of the pitch of the roof) or greater than 90 degrees.

FIG. 2 further illustrates that in accordance with at least some embodiments the affixation portion 21itself comprises an upper straddle member 16 and a lower straddle 18, the straddle members forming a slot 19 between them. In some embodiments, the distance between the upper straddle member 16 and the lower straddle member 18 may be dependent upon the thickness of the roofing material to which the decorative light support device 10 attaches. Thus, for example, if the decorative support device 10 is to be used on a roof having an illustrative 18 gauge metal roof material, the distance between the upper straddle member 16 and the lower straddle member 18 will be smaller than a decorative light support 10 configured for use with an illustrative 8 gauge metal roof material. In yet still further alternative embodiments, the distance between the upper straddle member 16 and the lower straddle member 20 may be such that the decorative light support device 10 will slide over or "straddle" any commercially available gauge of roofing material.

Still referring to FIG. 2, in order to ensure that the decorative light support device 10 is affixed to the metal roofing material 15, some embodiments utilize a fastener 24. In the embodiments illustrated in FIG. 2, the fastener 24 is threadingly attached to upper straddle member 16 by way of threaded aperture 20. In embodiments where the slot 19 formed between the upper straddle member 16 and the lower straddle member 18 is larger than the thickness of the roofing material to which the decorative support device attaches, the fastener 24 may be tightened against the roofing material to affix the decorative light support device 10 to the roofing material. Even in embodiments where the dimensions of the slot 19 are matched to the gauge of the roof material to which the decorative light support device attaches, a fastener 24 may be desirable to ensure that the decorative light support device stays attached, such as in high winds.

Figure 3:
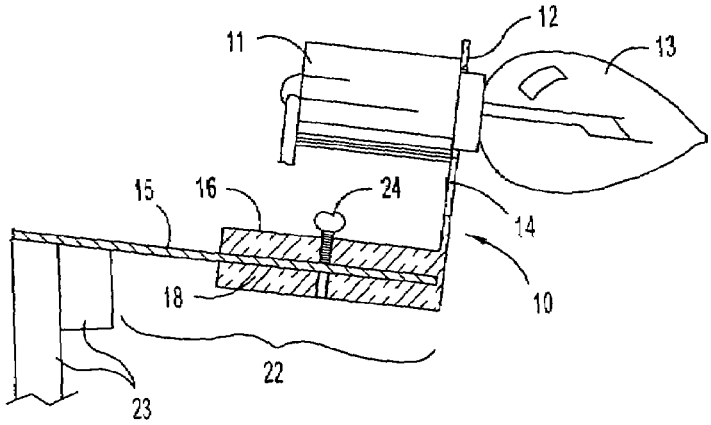
FIG. 3 illustrates a partial cross sectional view of a decorative light support device (taken along 3-3 of FIG. 1)

FIG. 3 shows a cross sectional view (taken substantially along 3-3 of FIG. 1). In particular, FIG. 3 illustrates the bulb 13 coupled to the socket 11 through the upper portion of the aperture 14. The decorative light support device 10 is shown to be "straddling" the metallic roof material 15. The fastener 24 is shown tightened against the metallic roof material 15, thus ensuring affixation of the decorative light support device 10 to the metal roof material 15. FIG. 3 also shows the relative relationship of the overhang portion 22 of the roofing material to the fascia material 23 of the building or structure. In particular, the inventor of the present specification has found that in most situations where a metal roofing material is used, the overhang portion of the roofing material 15 extends beyond the fascia material 23 approximately 1 inch to in some cases 6 inches. In accordance with at least some embodiments of the invention, the length of the upper and lower straddle members, as measured from the plane defined by the bulb retention portion 12, is from approximately 1 to 3 inches; however, longer or shorter length of the straddle members may be equivalently used.

Figure 4:
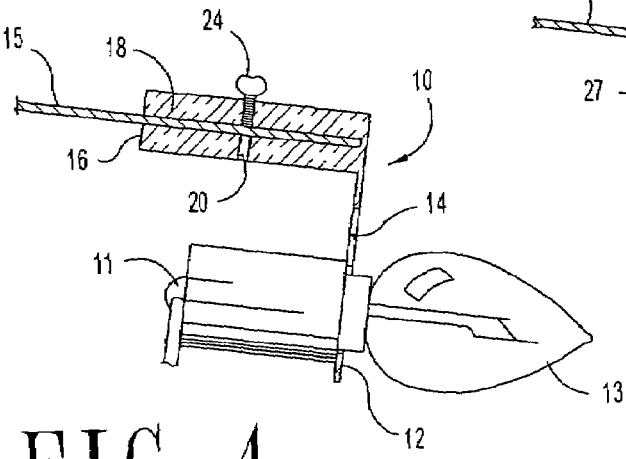
FIG. 4 illustrates alternative embodiments of the invention.

Turning now to FIG. 4, although the embodiments discussed in FIGS. 1-3 illustrate the fastener 24 to be threadingly coupled to the upper straddle member 16, in alternative embodiments, as illustrated in FIG. 4, the fastener 24 may be coupled to the lower straddle member 18. These alternative embodiments thus allow the fastener 24 to at least partially affix the decorative light support device 10 to the metallic roof material 15 without the head of fastener 24 being between the affixation portion 21 and the bulb socket 11. FIG. 4 also illustrates that, in yet further embodiments, both the upper straddle member 16 and the lower straddle member 18 may be configured to have a threaded aperture therein for accepting the fastener 24. FIGS. 2-4 illustrate each straddle member configured for use with a fastener, and therefore having a thickness sufficient to support the threads for the fastener. In alternative embodiments only one straddle member may be configured for use with the fastener, and the other straddle member may therefore have a thickness about the same as the thickness of the bulb retention portion 12.

Figure 5:
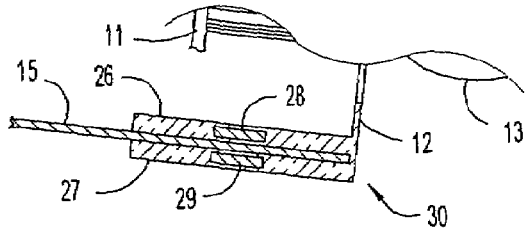
FIG. 5 illustrates yet sill further alternative embodiments of the invention.

The various embodiments discussed to this point utilize a fastener 24 to assist in affixing the decorative light support device 10 to the metallic roof material 15. However, FIG. 5 illustrates yet still further alternative embodiments where, rather than using a fastener 24, upper straddle member 26 has a magnet 28 coupled thereto. Likewise, lower straddle member 27 has a magnet 29 coupled thereto. Although the embodiments of FIG. 5 show each of the upper 26 and lower 27 straddle members having their magnets 28 and 29 respectively, decorative light support devices 10 where there is only one magnet (either in the upper or lower straddle member) may be equivalently used. Further, the magnets 28 and 29 are shown to be proximate to each other in placement within their respective straddle members; however, the magnets 28 and 29 may be equivalently laterally offset.

Figure 6:
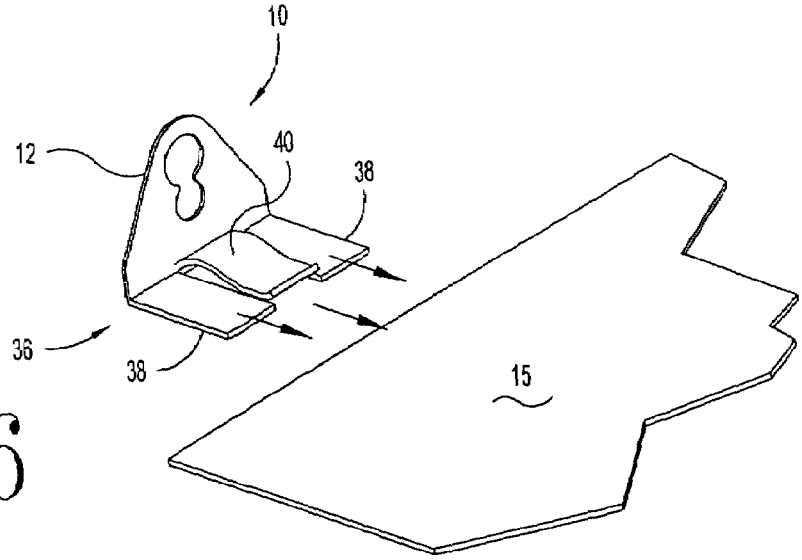
FIG. 6 illustrates alternative embodiments of the invention.

FIG. 6 illustrates yet further alternative embodiments of the decorative light support device 10. In particular, the decorative light support device 10 of FIG. 6 comprises the bulb retention portion 12 as well as the affixation portion 36. However, the affixation portion 36 in accordance with these embodiments comprises an upper straddle member 40 and two lower straddle members 38. In these embodiments, the upper straddle member 40 is biased toward the lower straddle members 38 such that, when slid over the roofing material 15, the upper straddle member 40 separates slightly from the lower straddle member 38. Because of the bias of the upper straddle members 40 in these embodiments, a force is applied that tends to bias the lower straddle member 38 against the roofing material 15. The force applied by the bias of upper straddle member 40 helps ensure that the decorative light support device 10 stays affixed to the roof material 15.

Various embodiments discussed to this point may be constructed of varying materials. In most situations it is envisioned that the decorative light support device 10 will be constructed of polypropolene, polystyrene, and/or any now known or after developed plastic material. In these embodiments made from plastic materials, it is envisioned that a straddle member configured for use with the fastener 24 will have a thickness of approximate 0.25 inches (as measured perpendicular to a plain defined by the affixation portion 21). In alternative embodiments, the decorative light support device 10 may be made from metal, and the embodiments illustrated in FIG. 6 lend themselves particularly well to construction from metal (although this is not strictly required).

The above discussion is meant to be illustrative of the principles and various embodiments of the present invention. Numerous variations and modifications will become apparent to those skilled in the art once the above disclosure is fully appreciated. For example, the various decorative light support devices disclosed herein may be equivalently used in situations where a non-metallic roofing material overhangs the fascia material. It is intended that the following claims be interpreted to embrace all such variations and modifications.

What is claimed is:

1. A decorative light support device comprising:

a bulb retention portion having an aperture;

an affixation portion coupled to the bulb retention portion, wherein the affixation portion comprises:

first straddle member;

second straddle member; and a fastener threadingly coupled through the first straddle member;

wherein the first and second straddle members are configured to straddle an overhanging portion of roofing material; and wherein the fastener is configured to affix the decorative light support device by tightening against the overhanging portion of roofing material, the fastener in direct physical contact with the overhanging portion of the roof material.

2. The decorative light support device as defined claim 1 wherein each of the first and second straddle members are configured for use with the fastener.

3. The decorative light support device as defined in claim 1 wherein first straddle member has a thickness, measured perpendicular to a plane defined by the affixation portion, of approximately 0.25 inches.

4. The decorative light support device as defined in claim 1 wherein the bulb retention portion and the affixation portion are made from one or more materials selected from the group: metal; polypropylene; or polystyrene.

5. The decorative light support device as defined in claim 1 wherein a plane defined by the bulb retention portion is substantially normal to a plane defined by the affixation portion.

6. The decorative light support device as defined in claim 1 wherein at least one the first straddle members has a length, as measured from a plane defined by the bulb retention portion, of approximately 1.0 inches to 3.0 inches.

7. A decorative light support device comprising:

a bulb retention portion having an aperture:

an affixation portion coupled to the bulb retention portion, wherein the affixation portion comprises:

first straddle member;

second straddle member;

the first and second straddle members configured to straddle an overhanging portion of roofing material, and to at least partially affix the decorative light support device to the roofing material; and a magnet coupled to the first straddle member wherein the magnet at least partially affixes the decorative light support device to the roofing material.

8. The decorative light support device as defined in claim 7 wherein the magnet is disposed at least partially within the first straddle member.

9. The decorative light support device as defined in claim 7 wherein each straddle member has a magnet coupled thereto.

10. A system comprising:

a means for supporting a bulb and socket assembly; and a means for forming a slot to straddle a roofing material overhang portion;

wherein the means for supporting defines a first plane, and the means for forming defines a second plane, and wherein the first and second planes define an angle between them;

wherein the means for forming a slot farther comprises a means for at least partially fastening the means for forming the slot to the roofing material overhang portion;

wherein the means for at least partially fastening comprises tightening a fastener against the overhanging portion of roofing material, the fastener in direct physical contact with the roofing material overhanging portion.

11. The system as defined in claim 10 wherein the angle between the first and second planes is approximately a right angle.

12. A system comprising:

a means for supporting a bulb and socket assembly; and a means for forming a slot to straddle a roofing material overhang portion;

said for supporting defines a first plane, and the means for forming defines a second planes, and wherein the first and second planes define an angle between them;

said means for forming further comprises a means for magnetically fastening the means for forming to the roofing material overhang portion, the means for magnetically fastening at least partially affixes the means for supporting and the means for forming to the roofing material.

13. A method comprising:

sliding a slot portion of a decorative bulb assembly over an overhang portion of roofing material such that the slot portion straddles the roofing material; and affixing, at least partially, the slot portion of the decorative bulb assembly to the roofing material;

wherein affixing further comprises tightening a fastener through at least one member forming the slot portion, the fastener in direct physical contact with the roof material.

14. A method comprising sliding a slot portion of a decorative bulb assembly over an overhang portion of roofing material such that the slot portion straddle the roofing material; and affixing, at least partially, the slot portion of the decorative bulb assembly to the roofing material by allowing a magnet coupled to at least one member forming the slot portion to magnetically attached to the roofing material.

* * * * *